US005501328A

United States Patent [19]

Keller et al.

[11] Patent Number: 5,501,328

[45] Date of Patent: Mar. 26, 1996

[54] COVER FOR GOLF BAG THROAT STRUCTURE

[75] Inventors: Gary E. Keller, Mesa; Gregory M. Suggs, Phoenix; John A. Solheim, Phoenix; Nip T. Lim, Phoenix, all of Ariz.

[73] Assignee: Karsten Manufacturing Corporation, Phoenix, Ariz.

[21] Appl. No.: 375,937

[22] Filed: Jan. 20, 1995

[51] Int. Cl.[6] ..... A63B 55/00

[52] U.S. Cl. ..... 206/315.6; 206/315.4

[58] Field of Search ..... 150/159; 206/315.2–315.8

[56] References Cited

U.S. PATENT DOCUMENTS

| | | | |
|---|---|---|---|
| 1,780,802 | 11/1930 | Sutcliffe | 206/315.6 |
| 1,849,610 | 3/1932 | Boyce | 206/315.6 |
| 3,331,419 | 7/1967 | Bencriscutto | 206/315.6 |
| 3,674,072 | 7/1972 | Shuto | 206/315.6 |
| 4,174,747 | 11/1979 | Boles | 206/315.6 |
| 4,596,328 | 6/1986 | Solheim | 206/315.3 |
| 4,600,100 | 7/1986 | Solheim | 206/315.3 X |
| 4,667,820 | 5/1987 | Solheim | 206/315.6 |
| 4,881,638 | 11/1989 | Cho | 206/315.3 |
| 4,905,827 | 3/1990 | Kim | 206/315.3 |
| 5,209,280 | 5/1993 | Gevas | 150/159 |

FOREIGN PATENT DOCUMENTS

| | | | |
|---|---|---|---|
| 4615020 | 1/1994 | Japan | 206/315.3 |
| 438747 | 11/1935 | United Kingdom | 206/315.5 |
| 705115 | 3/1954 | United Kingdom | 206/315.5 |
| 2256808 | 12/1992 | United Kingdom | 206/315.6 |

*Primary Examiner*—Sue A. Weaver
*Attorney, Agent, or Firm*—Darrell F. Marquette; Herbert E. Haynes, Jr.

[57] ABSTRACT

A cover for a golf bag throat structure is constructed to be easily removable from and reattachable to the throat structure. The cover includes an outer portion for covering a peripheral ring on the throat structure, and an inner portion for covering cross bars on the throat structure. The cover outer portion includes a first side wall disposed inside the peripheral ring, a second side wall disposed outside the peripheral ring, and a top wall connecting the side walls. A strip of material mounted on the first side wall is arranged for interlocking engagement with an internal lip extending circumferentially of the throat structure on the peripheral ring. The cover inner portion is substantially U-shaped in cross section including a pair of flanges that are detachably fastened together in order to attach the cover inner portion to the cross bars on the throat structure.

9 Claims, 4 Drawing Sheets

COVER FOR GOLF BAG THROAT STRUCTURE

BACKGROUND OF THE INVENTION

This invention relates generally to bags for carrying golf clubs and, in particular, to a cover for a golf bag throat structure.

Golf bags typically have a generally tubular body with a top end which is open and a bottom end which is closed. Golf clubs are inserted and removed from the golf bag through the open top end. As disclosed in U.S. Pat. No. 4,596,328 to John A. Solheim, the open top end of the golf bag may be defined by a throat structure preferably formed of plastic. The throat structure includes a peripheral ring and a pair of cross bars connected at their ends to the outer ring. When golf clubs are carried in the golf bag, the shafts of the golf clubs rest against the cross bars of the throat structure. Sometimes this causes the finish on the golf club shafts to become marred and scratched which is objectionable. A need exists for a cover for the throat structure that will reduce or prevent damage to the golf club shafts.

In the past, covers have been used on golf club throat structures but they have generally been permanently mounted on the golf bags. Although these permanent covers provide some protection against damage to golf club shafts, they are not removable for cleaning.

SUMMARY OF THE INVENTION

The present invention provides a cover for use with a golf bag wherein the golf bag has a body with a top end which is open and a bottom end which is closed. The top end of the body is defined by a throat structure that includes a peripheral ring and at least one cross bar connected at its ends to the peripheral ring. The cover is attachable to the throat structure and comprises an outer portion for covering the peripheral ring on the throat structure and an inner portion for covering the cross bar on the throat structure. The outer and inner portions are removable from and reattachable to the throat structure.

In the preferred embodiment of the cover, the outer portion comprises a first side wall disposed inside the throat structure peripheral ring, a second side wall disposed outside the throat structure peripheral ring, and a top wall connecting the first and second side walls. A strip of material mounted on the first side wall of the cover outer portion is arranged for interlocking engagement with a lip extending circumferentially of the throat structure on the peripheral ring. The cover inner portion is substantially U-shaped in cross section including a pair of flanges that are detachably fastened together in order to attach the cover inner portion to the cross bar on the throat structure. The cover outer portion has opposite ends joined together by connection means such as a buckle mechanism.

DESCRIPTION OF THE PREFERRED EMBODIMENT

Figure 1:
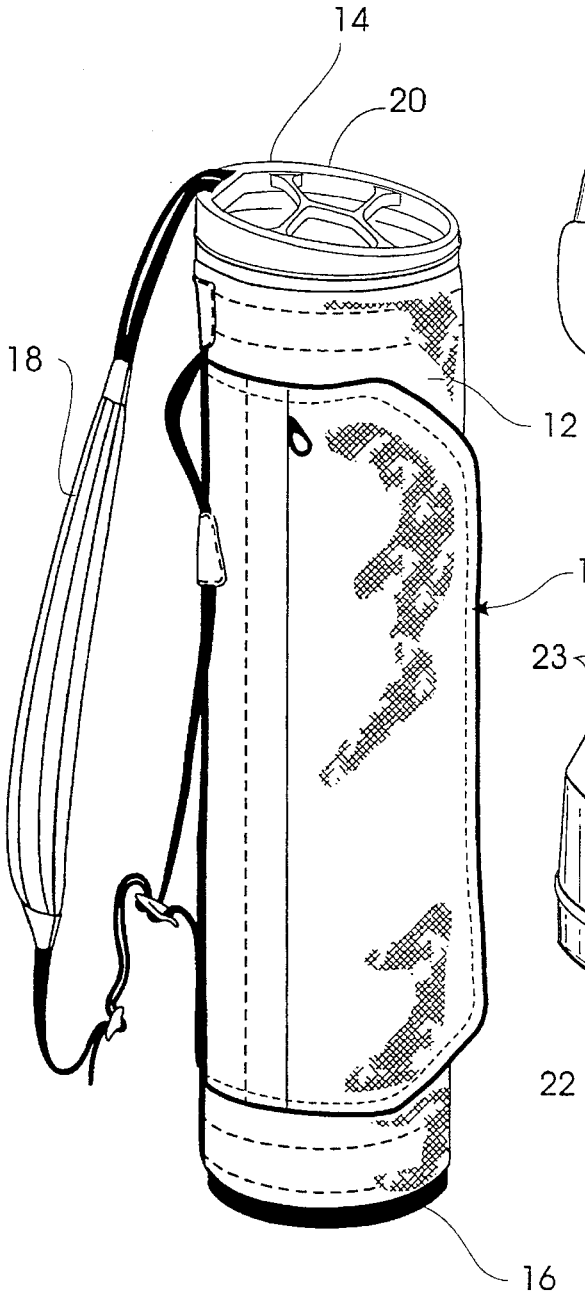
FIG. 1 is a side view of a golf bag incorporating a cover for a golf bag throat structure according to the preferred embodiment of the present invention.

Referring to FIG. 1, a golf bag 10 has a generally tubular body 12 with a top end 14 which is open and a bottom end 16 which is closed. Golf clubs may be inserted and removed through the top end 14 of the body 12 in conventional manner. A shoulder strap 18 is attached to the body 12 to facilitate carrying of the golf bag 10.

Figure 2:
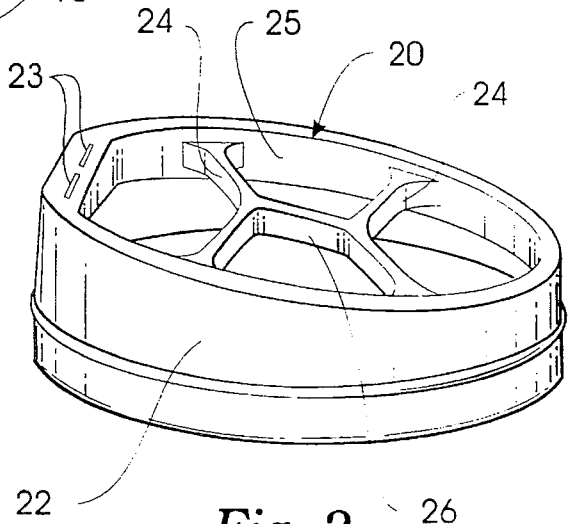
FIG. 2 is an enlarged view of the golf bag throat structure.
Figure 4:
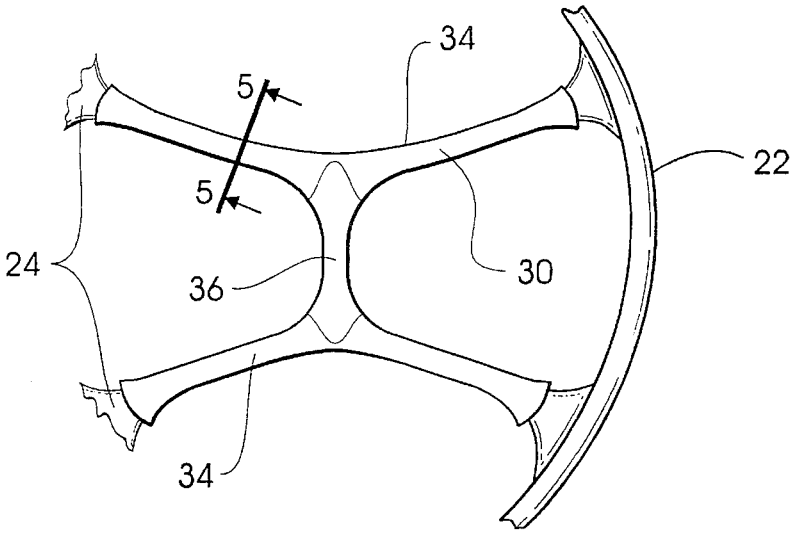
FIG. 4 is a top plan view of the golf bag throat structure, partly broken away, with an inner portion of the cover attached thereto.

The top end 14 of the body 12 is defined by a throat structure 20 which is also shown in FIG. 2 and which is similar to the throat structure disclosed in U.S. Pat. No. 4,596,328 to John A. Solheim. The throat structure 20 includes a peripheral ring 22 and a pair of cross bars 24 connected at their ends to the peripheral ring 22. The cross bars 24 are interconnected intermediate their ends by a rib 26. A pair of openings 23 are provided in the peripheral ring 22 to permit passage of the shoulder strap 18 through the throat structure 20, and an internal lip 25 on the peripheral ring 22 extends circumferentially of the throat structure 20.

Figure 3:
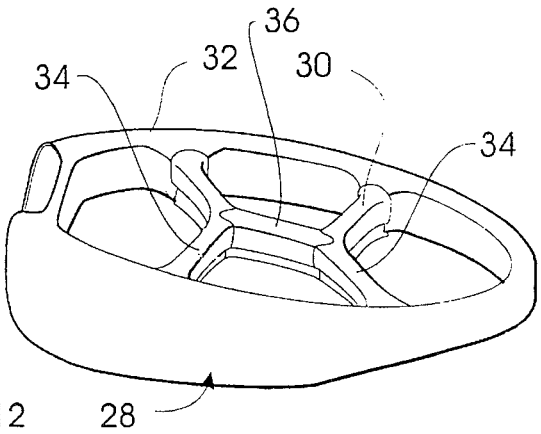
FIG. 3 is an enlarged view of the cover for the golf bag throat structure.

Referring to FIG. 3, a cover 28 is provided for covering the throat structure 20. The cover 28, preferably formed of a layer of suitable fabric such as velour bonded to a layer of foam material, includes an inner portion 30 and an outer portion 32. The cover outer portion 32 is attached to the peripheral ring 22, and the cover inner portion 30 is attached to the cross bars 24 and the rib 26. As discussed later, both the inner and outer portions 30, 32 of the cover 28 are constructed to be easily removable from and reattachable to the throat structure 20.

Figure 5:
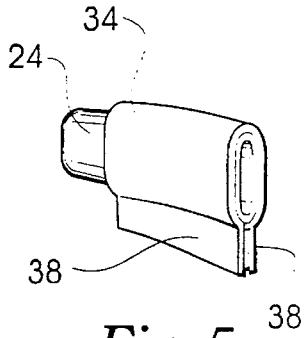
FIG. 5 is an enlarged sectional view taken along lines 5—5 in FIG. 4.
Figure 6:
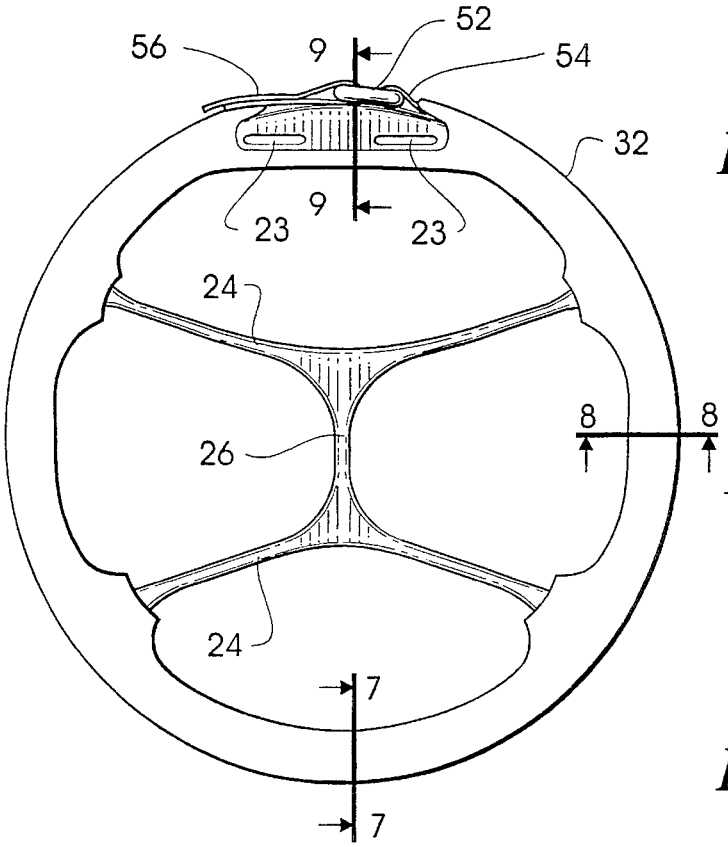
FIG. 6 is a top plan view of the golf bag throat structure with an outer portion of the cover attached thereto.

The cover inner portion 30 has cross bar sections 34 and a rib section 36 which cover the cross bars 24 and the rib 26, respectively, of the throat structure 20. The sections 34, 36 of the cover inner portion 30 are substantially U-shaped in cross section as seen in the sectional view of FIG. 5 and include a pair of flanges 38 that are secured to each other by conventional fastener means such as a hook and loop type of fastener. The cover inner portion 30 may be removed from the throat structure 20 by separating the flanges 38 from each other and then pulling the inner portion 30 off the throat structure 20.

As seen in FIGS. 6–9, the cover outer portion 32 has a first side wall 40 which is disposed inside the peripheral ring 22, a second side wall 42 disposed outside the peripheral ring 22, and a top wall 44 connecting the side walls 40 and 42.

Figure 7:
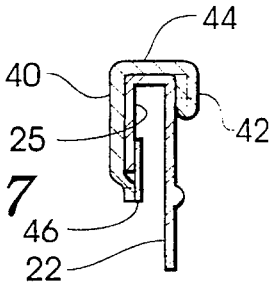
FIG. 7 is an enlarged sectional view taken along lines 7—7 in FIG. 6.
Figure 8:
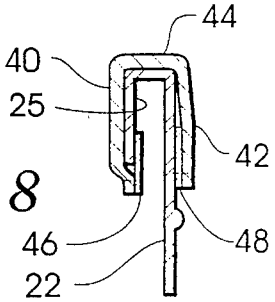
FIG. 8 is an enlarged sectional view taken along lines 8—8 in FIG. 6.
Figure 9:
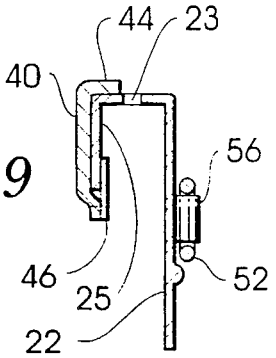
FIG. 9 is an enlarged sectional view taken along lines 9—9 in FIG. 6.

In one section of the cover outer portion 32, the side wall 42 consists of a double layer of material as shown in FIG. 7. In other sections of the cover outer portion 32, the side wall 40 has a strip 46 of plastic material mounted thereon by stitching. The strip 46 is arranged for interlocking engagement with the internal lip 25 on the peripheral ring 22. In further sections of the cover outer portion 32, the side wall 42 has a strip 48 of plastic material attached thereto by stitching as shown in FIG. 8. The strip 48 is sandwiched between the side wall 42 and the peripheral ring 22.

Figure 10:
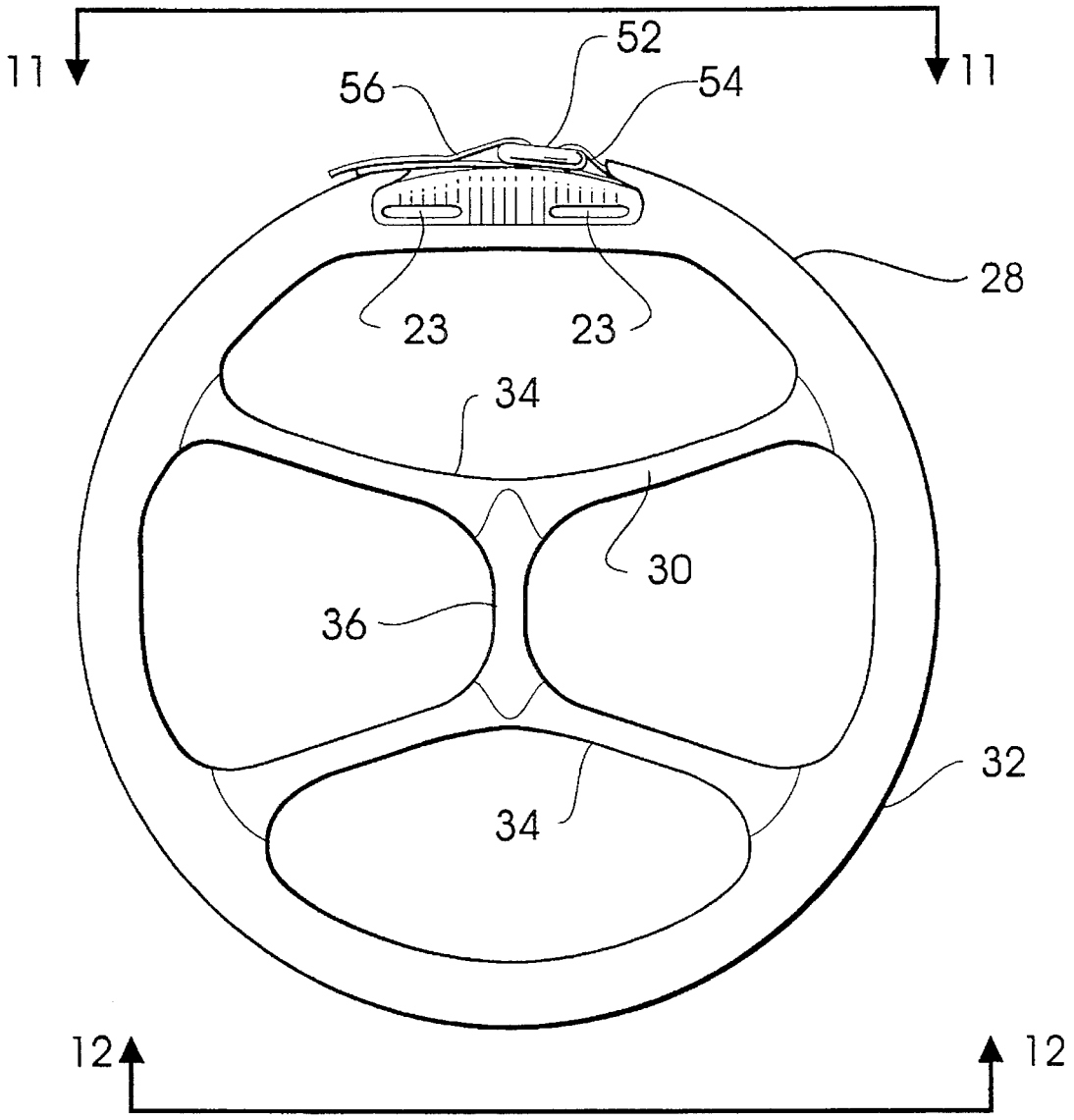
FIG. 10 is a top plan view of the golf bag throat structure with an alternative embodiment of the cover attached thereto.

FIG. 10 illustrates an alternative embodiment of the cover 28 wherein the inner and outer portions 30 and 32 thereof are joined together so that the cover 28 is made as a one-piece item. In this embodiment, the cross bar sections 34 of the inner portion 30 have their ends permanently secured such as by stitching to the outer portion 32.

Figure 11:
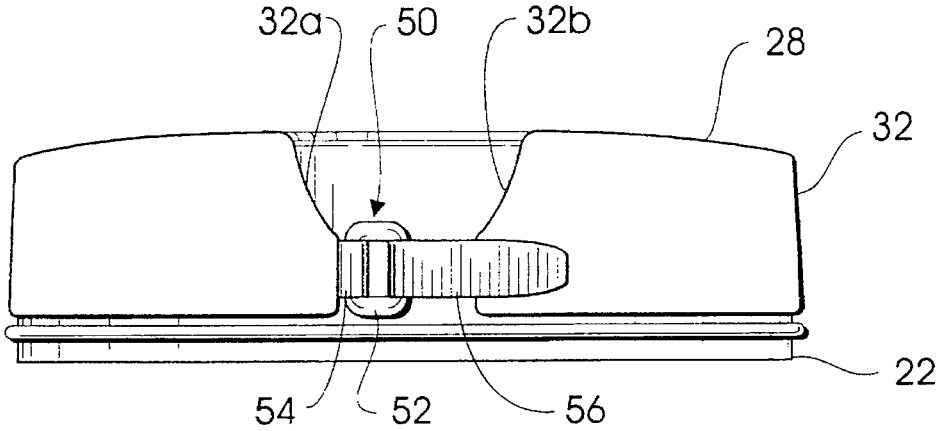
FIG. 11 is a rear elevational view taken along lines 11—11 in FIG. 10.
Figure 12:
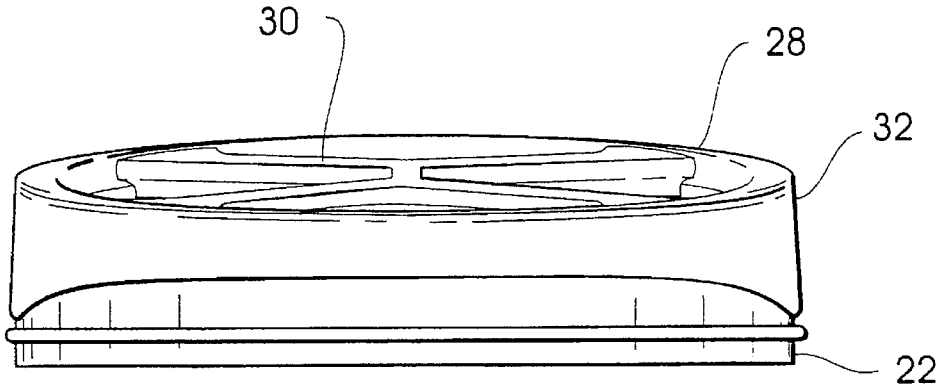
FIG. 12 is a front elevational view taken along lines 12—12 in FIG. 10.

As best shown in FIG. 11, the cover outer portion 32 has opposite ends 32*a*, 32*b* which are joined together by a buckle mechanism 50 consisting of a loop 52 and a strap 56. The loop 52 is permanently mounted on the end 32*a* of the cover outer portion 32 by another strap 54, and the strap 56 is mounted on the end 32*b* of the cover outer portion 32. One end of the strap 56 is inserted through the loop 52, and then the strap 56 is pulled in a manner which draws the cover outer portion ends 32*a*, 32*b* toward each other thereby tightening the cover outer portion 32 on the peripheral ring 22. It will be understood that the strap 56 attaches to itself by utilizing a hook and loop type of fastener on its adjoining surfaces.

Figure 13:
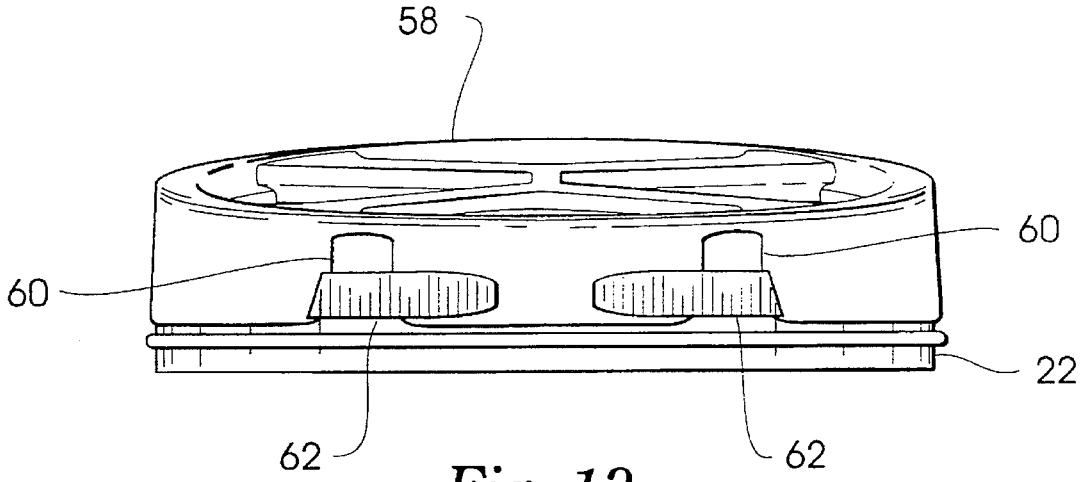
FIG. 13 is a front elevational view of a cover according to another embodiment of the present invention.

A further embodiment of the cover 58 shown in FIG. 13 includes a pair of slots 60 located generally opposite the buckle mechanism 50 to receive pivot assemblies for mounting legs of an extensible stand commonly used on golf bags. Such a stand is disclosed in U.S. Pat. No. 4,834,235 to John A. Solheim et al. The cover 58 also has a pair of straps 62 that are used to tighten the cover 58 on the peripheral ring 22. The straps 62 are similar in construction to the strap 56.

What is claimed is:

1. A cover for use with a golf bag wherein the golf bag has a body with a top end which is open and a bottom end which is closed, said top end of said body being defined by a throat structure that includes a peripheral ring and at least one cross bar connected at its ends to said peripheral ring, said cover being attachable to said throat structure and comprising:

an outer portion for covering said peripheral ring on said throat structure, said outer portion having opposed ends;

connection means on said outer portion for joining said opposed ends of said outer portion together;

an inner portion for covering said cross bar on said throat structure; and fastener means on said inner portion for removably attaching said inner portion to said throat structure cross bar.

2. The cover of claim 1, wherein said outer portion comprises a first side wall disposed inside said throat structure peripheral ring, a second side wall disposed outside said throat structure peripheral ring, and a top wall connecting said first and second side walls.

3. The cover of claim 2, wherein said outer portion further comprises a strip of material mounted on said first side wall, said strip of material being arranged for interlocking engagement with a lip extending circumferentially of said throat structure on said peripheral ring.

4. The cover of claim 1, wherein said inner portion is substantially U-shaped in cross section including a pair of flanges, and wherein said fastener means is located on said flanges for detachably fastening said flanges together in order to attach said inner portion to said cross bar on said throat structure.

5. The cover of claim 4, wherein said fastener means comprises a hook and loop fastener.

6. The cover of claim 1, wherein said outer and inner portions are separate and may be attached to and removed from said throat structure independently of each other.

7. The cover of claim 1, wherein said outer and inner portions are permanently secured together and are attached to said throat structure as a one-piece item.

8. The cover of claim 1, wherein said connection means comprises a buckle mechanism for drawing said opposite ends of said outer portion toward each other to thereby tighten said outer portion on said peripheral ring.

9. A cover for use with golf bag wherein the golf bag has a body with a top end which is open and a bottom end which is closed, said top end of said body being defined by a throat structure that includes a peripheral ring and at least one cross bar connected at its ends to said peripheral ring, said cover being attachable to said throat structure and comprising:

an outer portion for covering said peripheral ring on said throat structure, said outer portion including a first side wall disposed inside said peripheral ring, a second side wall disposed outside said peripheral ring, a top wall connecting said first and second side walls, and a strip of material mounted on said first side wall and being arranged for interlocking engagement with an internal lip extending circumferentially of said throat structure on said peripheral ring; and an inner portion for covering said cross bar on said throat structure, said inner portion being substantially U-shaped in cross section including a pair of flanges, fastener means on said flanges for detachably fastening said flanges together in order to attach said inner portion to said cross bar.

* * * * *